United States Patent [19]

Birch et al.

[11] Patent Number: 4,687,446

[45] Date of Patent: Aug. 18, 1987

[54] SEGMENTED CONSTRUCTION FOR ELECTRICAL CONNECTOR ASSEMBLY

[75] Inventors: Norman R. Birch, Jacobus; William V. Pauza, Palmyra; Wilmer L. Sheesley, Dauphin, all of Pa.

[73] Assignee: AMP Incorporated, Harrisburg, Pa.

[21] Appl. No.: 855,876

[22] Filed: Apr. 24, 1986

[51] Int. Cl.[4] ..... H01R 13/73

[52] U.S. Cl. ..... 439/553; 439/581

[58] Field of Search ..... 339/177, 208, 210, 212, 339/200–202, 136 R, 136 M, 138, 140, 141, 126 J, 126 RS

[56] References Cited

U.S. PATENT DOCUMENTS

| | | | |
|---|---|---|---|
| 2,374,971 | 5/1945 | Benander | 339/138 |
| 2,754,487 | 7/1956 | Carr et al. | 339/102 |
| 2,762,024 | 9/1956 | Heath | 339/126 RS |
| 2,919,421 | 12/1959 | Modrey | 339/126 RS |
| 2,933,714 | 4/1960 | Overholser | 339/177 R |
| 2,952,823 | 9/1960 | Robinson | 339/177 R |
| 3,879,517 | 4/1975 | Meyn | 264/135 |
| 4,129,352 | 12/1978 | Iizuka | 339/177 R |
| 4,136,921 | 1/1979 | Hardy et al. | 339/141 |
| 4,173,386 | 11/1979 | Kauffman et al. | 339/177 R |

FOREIGN PATENT DOCUMENTS

| | | | |
|---|---|---|---|
| 2500175 | 7/1976 | Fed. Rep. of Germany | 339/177 R |
| 73150 | 12/1960 | France . | |

*Primary Examiner*—Eugene F. Desmond
*Assistant Examiner*—David Pirlot
*Attorney, Agent, or Firm*—Gerald K. Kita

[57] ABSTRACT

An electrical connector assembly comprises a conductive electrical conductor having electrical contacts on tap portions, a composite insulative support for the conductor encircling the tap portions and being encircled by a hollow conductive shell, the shell having individual sleeve portions and a composite sleeve portion constructed of composite segments, a collar compressibly encircling the composite segments and urging them into abutment with one another without gaps therebetween, the individual sleeve portions being integral with corresponding composite segments, and corresponding individual sleeve portions urged by the collar into abutment with one another without gaps therebetween.

18 Claims, 10 Drawing Figures

SEGMENTED CONSTRUCTION FOR ELECTRICAL CONNECTOR ASSEMBLY

The invention relates to an electrical connector assembly that provides tap connections and is constructed of component parts that are encircled by a compression applying collar that holds the component parts in the assembly.

U.S. Pat. No. 3,201,743 discloses a known electrical connector that provides tap connections. The known connector includes a pin conductor having three branch portions. An insulative support encircles concentrically each of the branch portions. A conductive shell encircles concentrically the insulative support. The component parts of the known connector are fabricated for ease of assembly. For example, the insulative support has bipartite segments that abut each other. The branch portions of the pin conductor are readily inserted between the bipartite segments. The conductive shell has a channel portion open along one side to facilitate receipt of the insulative support. The channel is then formed by bending to a final sleeve form that encircles concentrically the insulative support. Bending must be performed with care to eliminate gaps in the shell that would cause undesired intrusion of electromotive interference or undesired escape of radio frequency electrical signals being transmitted along the pin conductor. Since the shell is constructed for bending, the shell provides only limited resistance to undesired bending or deformation.

The invention permits fabrication of tap connections in an electrical connector assembly with components parts that do not require bending to final shapes in the assembly. This advantageously permits a conductive shell of thick and rugged construction that resists undesired bending or deformation.

The invention further permits fabrication of tap connections in an electrical connector assembly with components parts that are encircled by a compression applying collar that holds the component parts in the assembly and urges the components parts into abutment with one another without undesired gaps therebetween.

An object of the invention is to provide an electrical connector assembly that provides tap connections and is constructed of component parts that are encircled by a compresion applying collar that holds the component parts in the assembly and in abutment with one another without gaps therebetween.

Another object of the invention is to provide an electrical connector assembly that provides tap connections and is constructed of component parts that do not require bending to final shapes in the assembly.

Another object of the invention is to provide an electrical connector assembly that provides tap connections and is constructed with a conductive shell of thick and rugged construction to resist undesired bending or deformation.

Another object of the invention is to provide an electrical connector assembly with tap connections, a conductive shell having individual sleeve portions integral with corresponding composite segments that abut one another to form a composite sleeve portion, and a compression applying collar that compressibly encircles the composite segments and urges the composite segments to abut one another without gaps therebetween and urges the individual sleeve portions to abut one another without gaps therebetween.

Other objects and advantages of the invention will be disclosed by a detailed description together with accompanying drawings, which together disclose by way of example one or more embodiments of the invention.

In the drawings, FIG. 1 is an enlarged, perspective view with parts shown exploded to illustrate the details of an electrical connector assembly;

Figure 5:
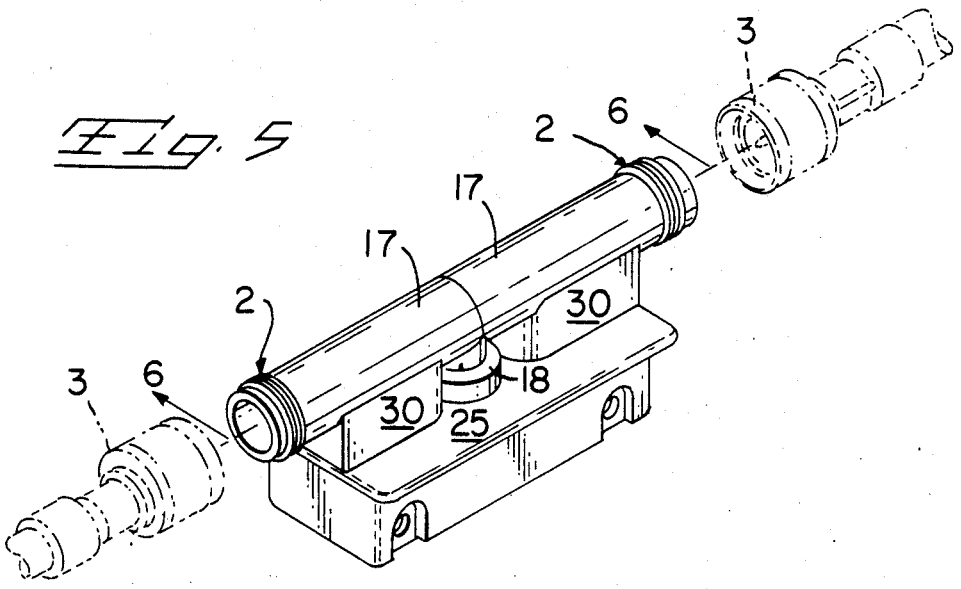
FIG. 5 is an enlarged, perspective view of another electrical connector assembly with complementary mating electrical connectors of cable assemblies shown in exploded configuration.
Figure 6:
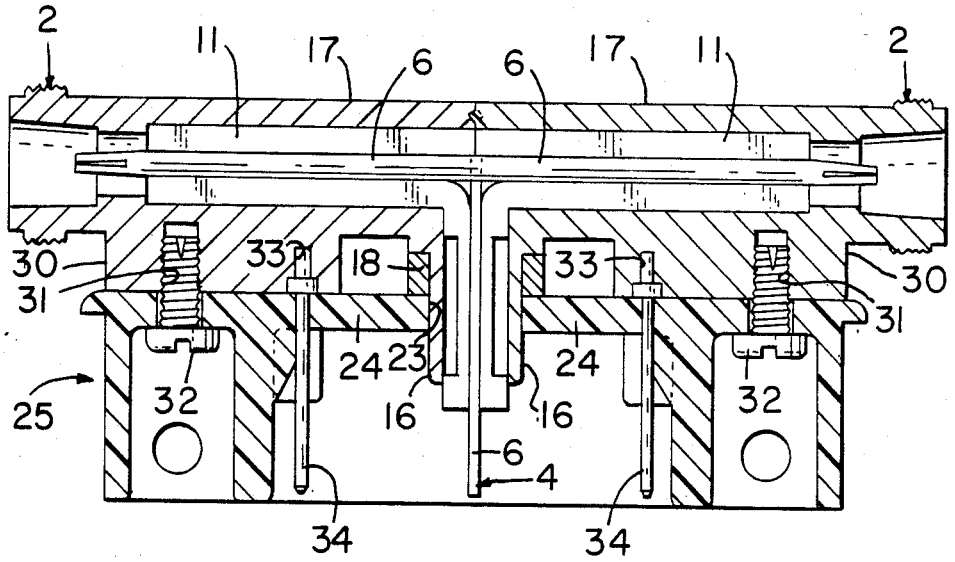
FIG. 6 is an enlarged, section view of said another electrical connector assembly shown in FIG. 5.
Figure 7:
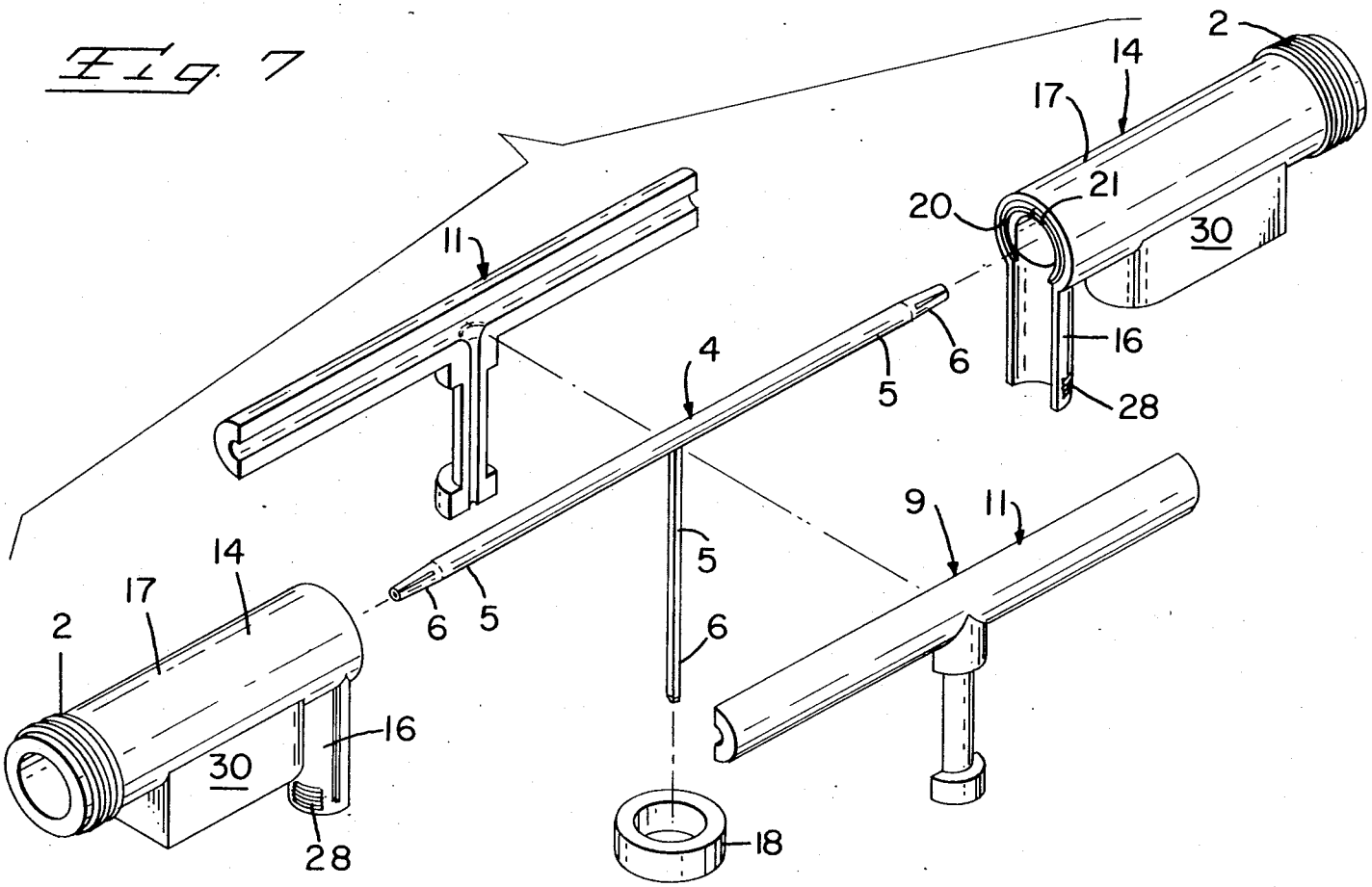
FIG. 7 is an enlarged, perspective view of some of the parts shown in FIGS. 4 through 6, illustrated in exploded configuration.

With more particular reference to the drawings, the invention will be described by way of example. FIGS. 1 through 4 illustrate one form of an electrical connector, FIGS. 5 through 7 illustrate another electrical connector. In describing the connectors, similar parts will have the same reference numerals. As shown in FIGS. 1 through 4, and similarly as shown in FIGS. 5 through 7, each electrical connector assembly 1 provides electrical tap connections with either bayonet coupler prongs 2, 2 or with threads 2, 2, for coupling with respective, known electrical coaxial connectors, shown by way of example at 3, 3. Further details of the known coaxial connectors 3, 3 are disclosed in U.S. Pat. No. 3,384,703.

The connector assembly 1 is fabricated from component parts that are constructed for ease of assembly. The component parts will now be disclosed in detail.

The connector assembly 1 includes a conductive electrical conductor 4 having elongated tap portions 5, 5, 5 and electrical contacts 6, 6, 6 on the ends of the tap portions 5, 5, 5. The electrical contacts 6, 6, 6 are in the form of either a pin 6 or an electrical receptacle 6, 6 having a hollow end 7, 6 provided with axial slits 8, 8 that allow resilient radial expansion of the hollow end 7, 7 for disconnect coupling to a corresponding known electrical connector 3, 3, for example, of the type disclosed in U.S. Pat. No. 3,384,703.

The connector assembly 1 includes an insulative support 9 for the conductor having elongated insulative portions 10, 10, 10 encircling respective tap portions 5, 5, 5 of the conductor 4. The insulative support 9 is constructed for ease of assembly with the conductor 4. For example, the insulative support 9 is divided into separate sections 11, 11 that are constructed to interfit against the conductor 4 and abut against one another along corresponding seams 12, 12, 12 that extend through respective insulative portions 10, 10, 10. FIGS. 1 through 4 show a bipartite insulative support 9 in duplicate sections 11, 11 having respective shallow channels 13, 13 that interfit against the conductor 4. The duplicate sections 11, 11 abut one another along a seam 12 that extends through each of the insulative portions 10, 10, 10.

Figure 10:
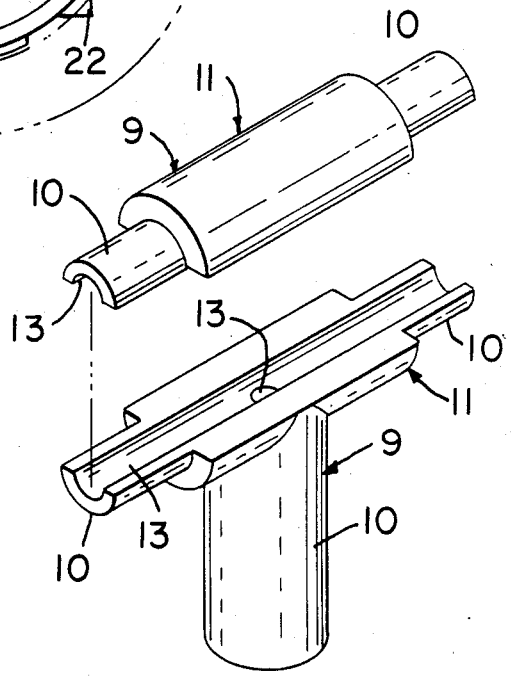
FIG. 10 is an enlarged, perspective view of an insulative body with sections in exploded configuration.

FIG. 10 shows a bipartite insulative support 9 in sections 11, 11. A first section 11 is T-shaped and has an axial bore 13 intersecting a shallow channel 13 extending perpendicular to the bore 13. The bore 13 interfits with the conductor 4 with one of the tap portions 5 inserted along the bore 13. The channel 13 interfits against the remaining tap portions 5,5 of the conductor 4. A second section 11 is semicylindrical and has a shallow channel 13 that interfits against corresponding tap portions 5,5 of the conductor 4. The sections 11, 11 abut one another along a seam 12 that extends through the insulative portions 10, 10, 10.

Further the connector assembly 1 includes a hollow conductive shell 14 that snugly encircles each of the insulative portions 10, 10, 10 of the insulative support 9. The shell 14 is constructed for ease of assembly with the insulative support 9. For example, the shell 14 has a composite sleeve portion 15 constructed of composite segments 16, 16 that abut one another to form the composite sleeve portion 15. The shell 14 has individual sleeve portions 17, 17 attached to corresponding composite segments 16, 16 of the shell 14. During assembly of the shell 14, the insulative portions 10, 10 of the insulative support 9 are inserted along the corresponding interiors of the individual sleeve portions 17, 17, and the composite segments 16, 16 are located in abutment with one another to form the composite sleeve portion 15 assembled snugly over a corresponding insulative portion 10. The edge of each seam 12, 12, 12 through the corresponding insulative portion 10, 10, 10 is purposely covered and bridged across by a seamless section of a corresponding sleeve portion 16, 17, 17 of the shell 14. Thereby the seam 12, 12, 12 is substantially covered by the shell 14 to prevent undesired intrusion of electromotive interference or escape of electrical signals being transmitted along the conductor.

The connector assembly 1 further includes means 18 in the form of a collar 18 that encircles the composite segments 16, 16. The collar 18 is illustrated as being circular. The collar 18 may have a shape other than as illustrated without departing from the scope of the invention. A function of the means 18, for example, the collar 18, is to hold the composite segments 16, 16 and urge them into abutment with one another along abutting edges 19, 19 without gaps therebetween.

Figure 8:
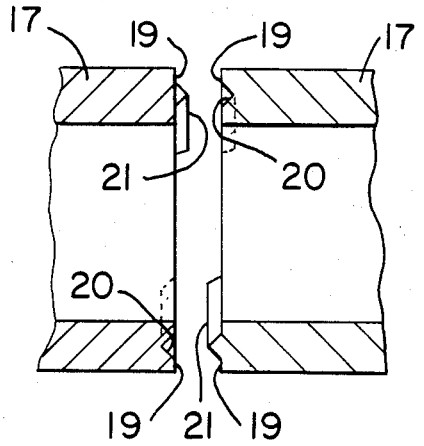
FIG. 8 is an enlarged, fragmentary section through the axes of corresponding parts shown in FIGS. 1 through 6.
Figure 9:
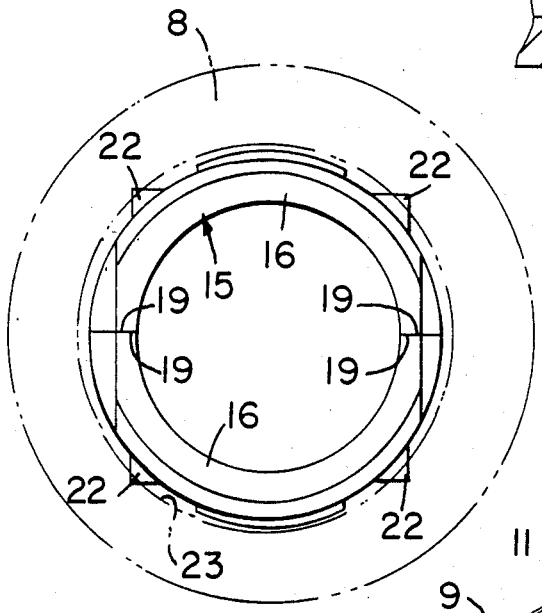
FIG. 9 is a schematic view illustrating an interference fit between certain of the parts shown in FIGS. 1 through 6.

Another function of the means 18 is to urge corresponding sleeve portions 17, 17 into abutment with one another along their abutting edges 19, 19 without gaps therebetween. For example, the individual sleeve portions 17, 17 are attached to corresponding composite segments 16, 16 of the shell. When the composite segments 16, 16 are urged into abutment with one another, corresponding ones of the individual sleeve portions 17, 17, that are attached to the segments 16, 16, also are urged by the collar 18 into abutment with one another. These corresponding ones of the individual sleeve portions 17, 17, are provided with abutting edges 19, 19 that are urged by the collar 18 into abutment with one another without gaps therebetween. The absence of gaps in the shell 14 prevents undesired intrusion of electromotive interference or escape of electrical signals being transmitted along the electrical conductor. Further to insure the absence of gaps, and as shown in FIG. 8, the abutting edges 19, 19 nest together by way of a channel 20, 20, provided along a corresponding abutting edge 19, 19, and a projecting rib 21, 21, provided along a corresponding abutting edge 19, 19 and received in a corresponding channel 20, 20.

As shown in FIGS. 1, 3, 4, 7 and 9, raised ribs 22, 22 are on the exterior of each corresponding composite segment 16, 16, and extend axially along the corresponding composite sleeve portion 15 adjacent to the individual sleeve portions 17, 17 that are attached to corresponding composite segments 16, 16. The interior 23 of the collar 18 is passed axially along the composite sleeve portion 15 until engaged and stopped against one of the individual sleeve portions 17, 17. The collar 18 forms an interference fit with the raised ribs 22, 22. The ribs 22, 22 are compressed against the interior 23 of the collar 18. Compression is sufficiently intensive that the ribs 22, 22 are distorted by being frictionally abraded by the collar 18 and are rigidly compressed against the interior 23 of the collar 18. Thereby the collar 18 is secured in place, and compression that is applied by the collar 18 is transferred to the edges 19, 19 on the abutting composite segments and the edges 19, 19 on the corresponding individual sleeve portions 17, 17 that abut one another.

Figure 1:
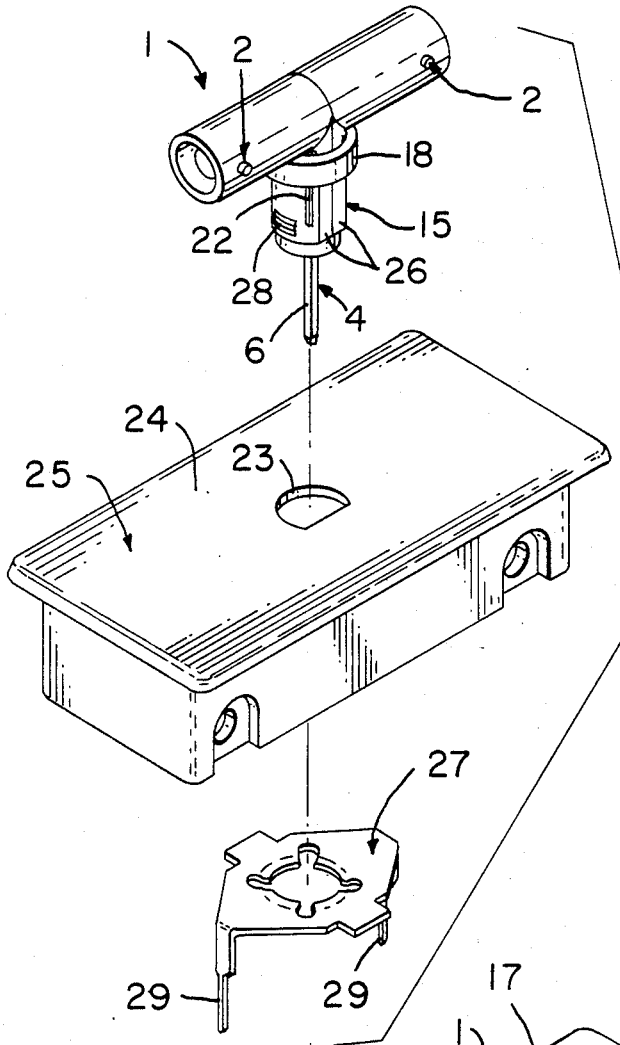
Figure 2:
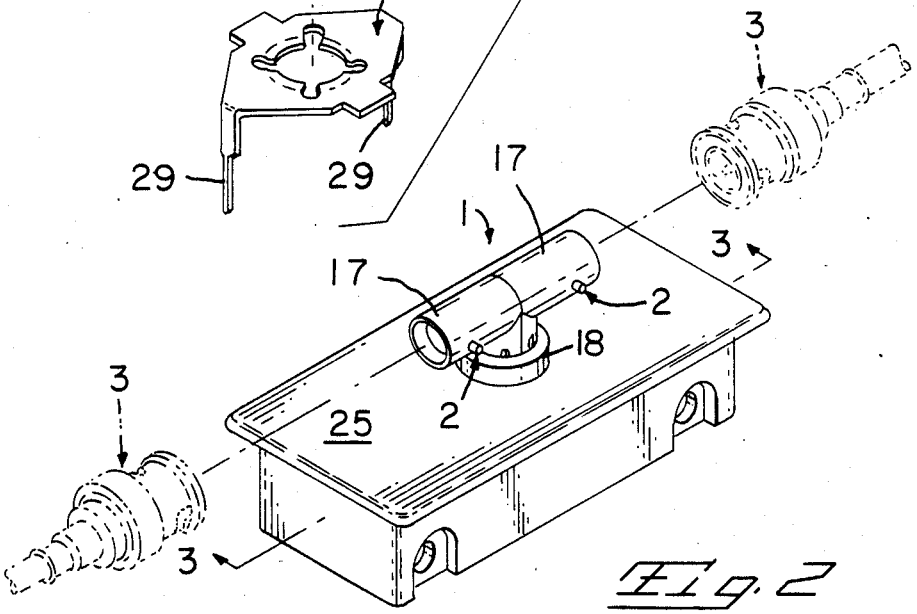
FIG. 2 is an enlarged, perspective view of an assembly of the parts shown in FIG. 1, together with respective complementary mating connectors of cable assemblies.
Figure 3:
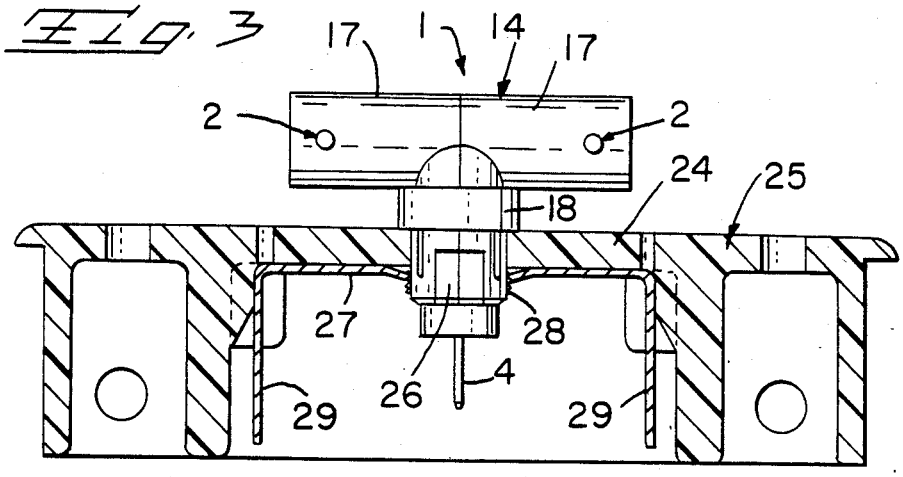
FIG. 3 is an enlarged, section view of the assembly shown in FIG. 2.
Figure 4:
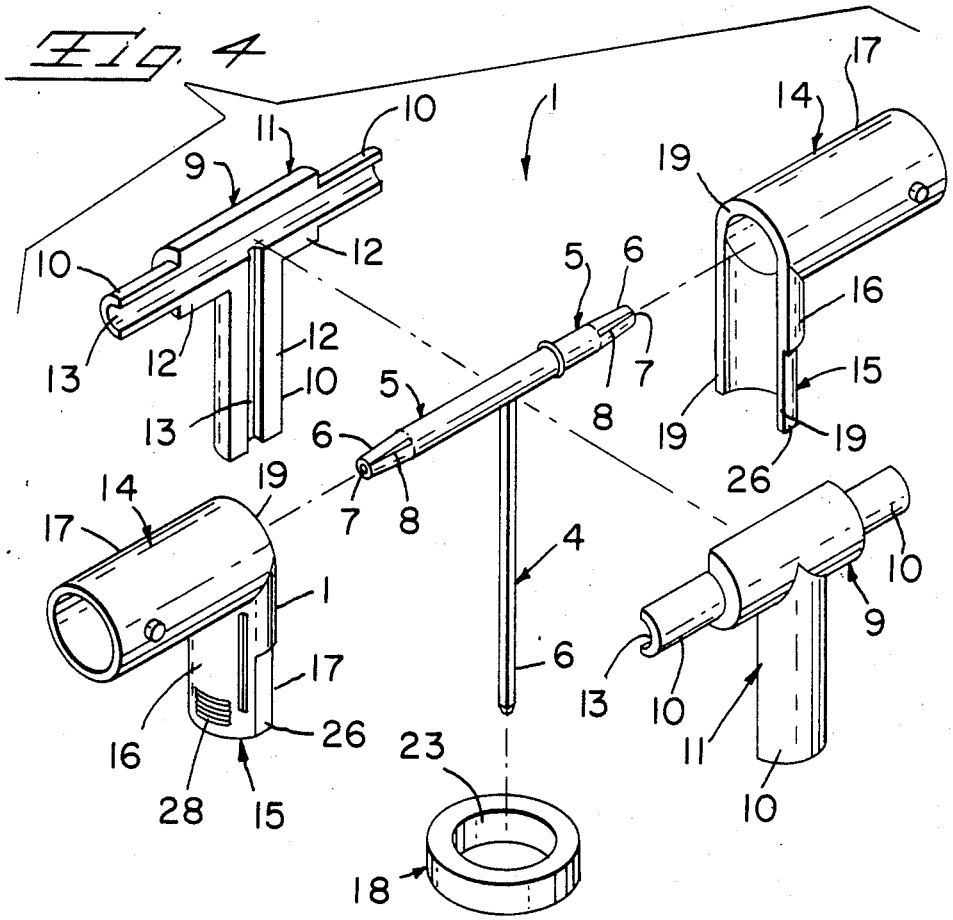
FIG. 4 is an enlarged, perspective view of some of the parts shown in FIGS. 1 through 3, illustrated in exploded configuration.

As shown in FIGS. 1 and 6, the composite sleeve portion 15 projects within an opening 23 in a wall 24 of a panel 25 in the form of a box 25. The opening 23 is sized to interfit with a section of reduced width of the composite sleeve portion 15, thereby to prevent rotation of the connector 1. The section of reduced width is provided by a flat 26 along the exterior of the composite sleeve portion 15.

The collar 18 engages the panel 25 and provides a pedestal 8 having a height equal to the length of the collar 18 along its axis. The length of the collar 18 is sufficient to provide access clearance between the panel 25 and the individual sleeve portion 17, 17 of the shell. Further the length of the collar 18 is sufficient to distribute the compression along the composite sleeve portion 15. The shell 14 is sufficiently thick and rugged to withstand the intensive compression.

A metal clip 27 is assembled on the end of the composite sleeve portion 15 to prevent its removal from the panel opening 23. The free end of the composite sleeve portion 15 is provided with a roughened surface 28 against which the clip 27 is frictionally secured and electrically connected. The clip 27 is in compression against the panel 25. This would establish an electrical connection between the connector 1 and the panel 25 which can be fabricated from conductive material. As shown, the panel 25 is constructed of insulative material. The clip 26 has integral conductors 29, 29 in the form of pins 29, 29 that project in the same direction as the pin 6 of the conductor 4. The pins 6, 29, 29 project outwardly from the wall 24 of the panel 25 and serve as electrical terminals 6, 29, 29 for establishing electrical connections to electrical equipment, not shown.

FIGS. 5, 6 and 7 show a pedestal 30, 30 attached to a corresponding individual sleeve portion 17, 17 and constructed with a threaded opening 31, 31 to receive a threaded fastener 32, 32 extending through the wall 24 of the panel 25. The pedestal 30, 30 assists in anchoring the connector 1 to the panel 25. The pedestal 30, 30 also may have a socket 33, 33 for mounting a projecting conductor pin 34, 34 that projects in the same direction as the pin 6 of the connector 4, and serves as an electrical terminal 34, 34 for establishing an electrical connection with an item of electrical equipment, not shown. The pins 34, 34 are used alternatively in place of the clip 27 and the pins 29, 29.

What is claimed is:

1. An electrical connector assembly, comprising:

an electrical conductor having elongated tap portions and electrical contacts on respective tap portions, an insulative support for the conductor having insulative portions encircling respective tap portions of the conductor, a hollow conductive shell having individual sleeve portions and a composite sleeve portion, the individual sleeve portions abutting one another and encircling respective insulative portions of the insulative support, the individual sleeve portions being provided with abutting edges, and the composite sleeve portion encircling a corresponding inslutative portion of the insulative support and being constructed of composite segments attached to corresponding individual sleeve portions and abutting one another to form the composite sleeve portion, and means holding the composite segments for urging the composite segments into abutment with one another without gaps therebetween, and for urging the abutting edges of the individual sleeve portions into abutment with one another without gaps therebetween.

2. An electrical connector assembly as recited in claim 1, wherein raised ribs on the exterior of corresponding composite segments are distorted by the means and are compressed against the interior of the means.

3. An electrical connector assembly as recited in claim 1, wherein the means abuts an individual sleeve portion of the shell and forms a pedestal having a height corresponding to a length of the means.

4. An electrical connector assembly as recited in claim 1, wherein the means is a collar encircling the composite segments of the composite sleeve portion.

5. An electrical connector assembly as recited in claim 4, wherein the collar is slidably mounted along the composite segments, and further including, stop means on at least one of the individual sleeve portions for engagement by the collar.

6. An electrical connector assembly as recited in claim 1, wherein corresponding insulative portions are each constructed with a seam and with insulative sections that abut one another along the seams without gaps therebetween, and an edge of each said seam is covered by a seamless section of a corresponding individual sleeve portion of the shell.

7. An electrical connector assembly as recited in claim 1, wherein individual sleeve portions are provided with corresponding pedestals projecting in the same direction as that of the composite sleeve portion.

8. An electrical connector assembly as recited in claim 1, wherein a free end of the composite sleeve portion is provided with a roughened surface and is encircled by a conductive clip frictionally secured against the roughened surface, and conductive pins project outwardly from the clip.

9. An electrical connector assembly as recited in claim 1, wherein the composite sleeve portion is surrounded by a conductive clip frictionally secured to the composite sleeve portion, and conductive pins are integral with the clip and project in the same direction as the composite sleeve portion.

10. An electrical connector assembly as recited in claim 3, 4, 5, 6, 7, 8 or 9, wherein raised ribs on the exterior of corresponding composite segments are frictionally abraded by the means and are compressed against the interior of the means.

11. An electrical connector assembly as recited in claim 4, 5, 6, 7, 8 or 9, wherein the means abuts an individual sleeve portion of the shell and forms a pedestal having a height corresponding to a length of the means.

12. An electrical connector assembly as recited in claim 6, 7, 8, or 9, wherein the means is a collar encircling the composite segments of the composite sleeve portion.

13. An electrical connector assembly as recited in claim 7, 8 or 9, wherein corresponding insulative portions are each constructed with a seam and with insulative sections that abut one another along the seams without gaps therebetween, and an edge of each said seam is covered by a seamless section of a corresponding individual sleeve portion.

14. An electrical connector assembly as recited in claim 8 or 9, wherein individual sleeve portions are provided with corresponding pedestals projecting in the same direction as that of the composite sleeve portion.

15. An electrical connector assembly as recited in claim 9, wherein a free end of the composite sleeve portion is provided with a roughened surface and is encircled by a conductive clip frictionally secured against the roughened surface, and conductive pins project outwardly from the clip.

16. An electrical connector assembly comprising, an electrical conductor having elongated branch portions and an electrical terminal on one of the branch portions, an insulative support for the conductor having insulative portions encircling respective branch portions of the conductor, a hollow conductive shell encircling respective insulative portions of the insulative support, a panel having an opening, said electrical terminal and the conductive shell projecting through the opening, and a metal clip frictionally secured on and electrically connected to the conductive shell and in compression against the panel, the clip having electrical conductors serving as electrical terminals and projecting in the same direction as said electrical terminal of the electrical conductor.

17. An electrical connector as recited in claim 16, wherein the electrical conductors of said clip are integral with said clip.

18. An electrical connector as recited in claim 16 or 17, and further including means on said conductive shell for providing a pedestal engaging said panel, and said panel is between said means and said clip.

* * * * *